United States Patent [19]

Cina et al.

[11] 3,957,542

[45] May 18, 1976

[54] HEAT TREATMENT METHOD FOR EXTENDING THE SECONDARY CREEP LIFE OF ALLOYS

[75] Inventors: Baruch Cina, Ramat Gan; Michael Meron, Tel Aviv; Stuart Maurice Myron, Ganey Yehuda; Gidon Dror, Tel Aviv, all of Israel

[73] Assignee: Israel Aircraft Industries, Ltd., Israel

[22] Filed: Feb. 21, 1975

[21] Appl. No.: 551,776

[30] Foreign Application Priority Data

Nov. 25, 1974 Israel ..... 46114

[52] U.S. Cl. ..... 148/12.3; 148/12.7 R

[51] Int. Cl.[2] ..... C21D 6/02; C22F 1/04; C22F 1/10; C22F 1/18

[58] Field of Search..... 148/12.3, 12.7, 2, 12.7 R, 148/12.7 A, 12.7 B, 12.7 N

[56] References Cited

UNITED STATES PATENTS 3,817,796 6/1974 Kramer ..... 148/12.7 R

*Primary Examiner*—R. Dean

*Attorney, Agent, or Firm*—Benjamin J. Barish

[57] ABSTRACT

A method for extending the secondary creep life of an alloy part which had previously been subjected to a solution heat treatment at a high temperature and to a subsequent precipitation hardening heat treatment at a lower temperature, the method being characterized by subjecting the part, after it has experienced significant secondary creep but before tertiary creep has set in, to a recuperative heat treatment at a temperature substantially below the solution heat treatment temperature, and preferably above the precipitation hardening heat treatment temperature, while the part is unstressed.

11 Claims, 3 Drawing Figures

HEAT TREATMENT METHOD FOR EXTENDING THE SECONDARY CREEP LIFE OF ALLOYS

BACKGROUND OF THE INVENTION

The present invention relates to a method of extending the secondary creep life of alloys, such as those used for turbine blades and for other high-temperature high-stress applications. The invention is particularly useful with respect to nickel-base superalloys but can also advantageously be used for increasing the creep life of other alloys, such as those of cobalt, iron, titanium, and aluminum.

The term "creep" refers to the deformation or dimensional changes experienced by a metal part when subjected to sustained stress at elevated temperatures. Such dimensional changes are generally recognized as being divided into three stages, namely: (1) the initial stage, called primary creep, wherein the rate of deformation is relatively large at first, and then gradually decreases; (2) the secondary stage, called secondary creep, wherein the rate of deformation is a relatively steady one; and (3) the final stage, called tertiary creep, wherein the rate of deformation at first gradually increases and then more sharply increases until rupture occurs.

A large number of superalloys have been developed providing high tensile, creep and fatigue strength at elevated temperatures. Such alloys are usually first subjected to a solution heat treatment at a high temperature in order to dissolve the alloy ingredients, and then to a precipitation hardening heat treatment at a lower temperature to precipitate them from the solid solution. Creep-resistant properties are extremely important in aircraft engines, for example, particularly for making turbine blades and discs which are subject to high, sustained tensile stresses at elevated temperatures by the centrifugal forces acting upon them in service. In order to realise maximum efficiency, gas turbine engines are operated under conditions which, in many cases, cause the creep lives of the turbine blades and discs to be limited. During periodic overhauls, the dimensions of the blades are usually measured, and when they exceed a predetermined tolerance, due to creep, the blades are scrapped. Such blades are very costly to produce, and therefore their scrapping involves a very substantial expense. Furthermore, there are cases where complete mechanical failure of a blade has occurred without its having reached its expected permissible life. In certain cases, discs, which can cost tens of thousands of dollars, are scrapped at fixed time periods of service even without their showing signs of damage, simply because of the fear that they may fail catastrophically on further service because of creep.

For the foregoing reasons, considerable efforts have been devoted to providing a method of increasing the safe working life of turbine blades and discs. Some of these efforts have been directed towards attempts to cure creep damage by various heat treatments mainly in the tertiary stage of creep, but this work has met with very limited success. Other work has been directed towards applying a "regenerative" heat treatment to the superalloy part, in which the original solution heat treatment at a high temperature and subsequent precipitation hardening heat treatment at a lower temperature, were repeated after the part had sustained creep during service, but this work has also met with very limited or no success.

BRIEF SUMMARY OF THE INVENTION

According to the present invention, there is provided a method of extending the secondary creep life of a part made of an alloy which alloy had previously been subjected to a solution heat treatment at a high temperature and to a subsequent precipitation hardening heat treatment at a lower temperature, characterized in subjecting the part, after it has experienced significant secondary creep because of sustained stress at an elevated service temperature but before tertiary creep has set in, to a recuperative heat treatment at a temperature substantially below the solution heat treatment temperature while the part is unstressed.

Preferably, and particularly in the case of nickel-base superalloys, the recuperative heat treatment is applied at a temperature above the precipitation hardening heat treatment temperature.

Particularly good results have been obtained, as will be shown in the examples described below involving two nickel-base superalloys, when the superalloy part is subjected to the recuperative heat treatment after the part has experienced from about 45 – 70% secondary creep. In the preferred nickel-base alloy examples described below, the recuperative heat treatment should be applied at a temperature of at least 150C° below the solution heat treatment temperature, and preferably between the precipitation hardening temperature and the maximum service temperature of the part. Better results are generally obtained when the recuperative heat treatment temperature is at the higher end of this range, optimally at the maximum service temperature of the part.

The recuperative heat treatment should be applied for at least one hour. Particularly good results have been obtained when it is applied for a period in the order of 10–30 hours.

While especially good results have been obtained with respect to nickel-base superalloys, the recuperative heat treatment described can also advantageously be used for increasing the creep life of other alloys, such as those of cobalt, iron, titanium, and aluminum; the description below includes an example of a recuperative heat treatment for each one of these alloys.

BRIEF DESCRIPTION OF THE DRAWINGS

The invention and the advantages produced thereby will be better understood and appreciated by the several examples described below in connection with the accompanying drawings, wherein.

DESCRIPTION OF THE PREFERRED EMBODIMENTS

Figure 1:
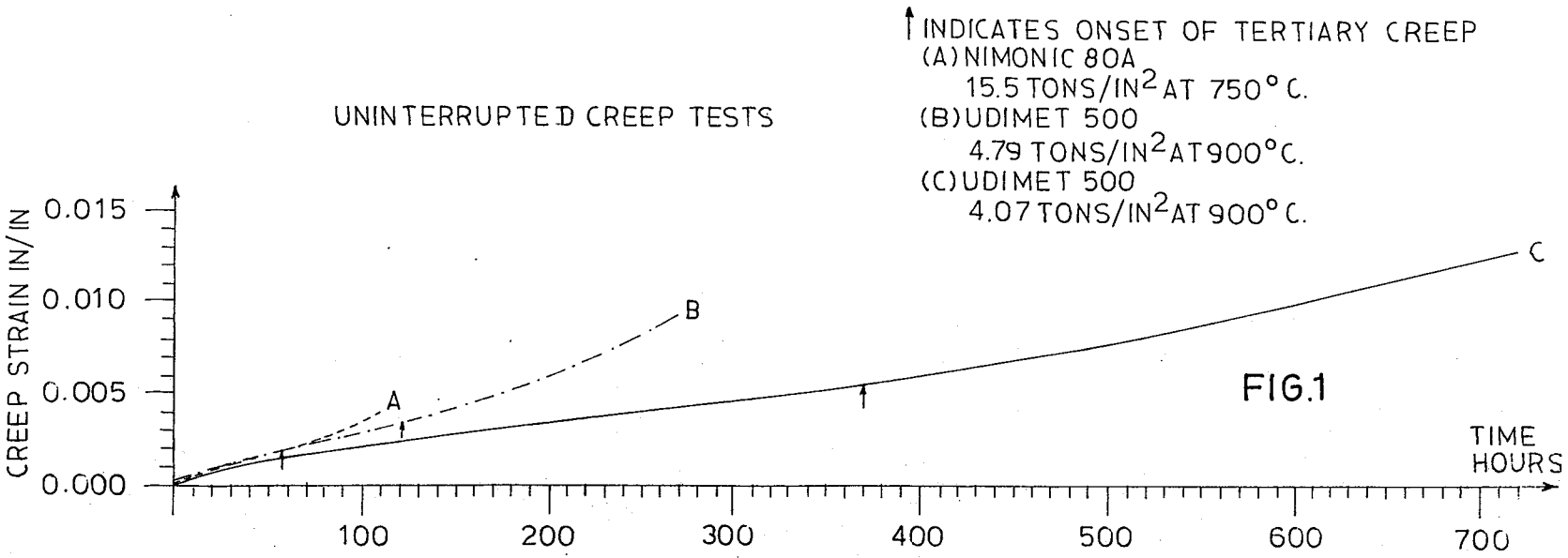
FIG. 1 is a chart illustrating the creep-strain-vs-time relationship resulting from uninterrupted creep tests applied to two nickel-base superalloys, i.e., without interruption for the recuperative heat treatment of the present invention.

The following preliminary explanation may be helpful in understanding what appears to be the mechanism or theory of action of the present invention, but it will be appreciated that we do not wish to be limited to this mechanism or theory.

From prior work performed in the field of superalloys, it appears that, during secondary creep, lattice vacancies diffuse to and coalesce at grain boundaries. During the tertiary stage of creep, these lattice vacancies form microscopic pores, which serve as points of stress-concentration. These pores then develop into or unite to form grain boundary cracks, and when the cracks join or develop sufficiently, rupture results.

It is believed that the recuperature heat treatment of the present invention, when applied at an intermediate stage of the secondary creep life, disperses these potentially dangerous concentrations of lattice vacancies by a process of diffusion, and thereby substantially extends the secondary creep life of the part.

Once the microscopic pores or grain boundary cracks have formed, this occurring in the tertiary stage of creep life, we do not believe that they can be healed by a heat treatment. This is why, we feel, the prior effects directed towards heat treating the parts during the tertiary stage of creep have met with little or no success. However, while the concentrations of vacancies are still on the atomic scale, we believe they are amenable to dispersion by appropriate heat treatment. This is the reason we feel that the recuperative heat treatment of the present invention, being applied during the secondary stage of creep, has been found effective to extend substantially the creep life of the superalloy part.

We have also found, as will be shown below, that the effectiveness of the heat treatment, measured in terms of the increase in life before the onset of tertiary creep, depends to a great extent on the time at which the part is removed from service and is subjected to the recuperative heat treatment. In the examples described below of two nickel-base superalloys, it was found that a sharp extension in the life of the part was obtained when the part was subjected to the recuperative heat treatment after it had experienced from about 45–70% secondary creep. However, for the sake of convenience, routine maintenance procedures may be provided in which the recuperative heat treatment is performed each time the part is removed for overhaul.

The recuperative heat treatment should be applied at a temperature substantially below the original solution heat treatment temperature. In the described examples of nickel-base superalloys, the recuperative heat treatment temperature was at least 150C° below the original solution heat treatment temperature. With respect to the lower limit of the recuperative heat treatment, it should be above the original precipitation hardening heat treatment temperature of the alloy, particularly in the case of nickel-base superalloys, but it should be no higher than the maximum service temperature of the part, thereby assuring that undesirable physical or chemical changes will not be produced in the alloy by the recuperative heat-treatment.

With respect to the time of the recuperative heat treatment, it should be applied for at least 1 hour to enable dispersion of the potentially dangerous concentrations of lattice vacancies. Preferably it should be applied for a period in the order of 10–30 hours. As a matter of convenience, the treatment may be applied overnight.

Described below are a number of examples in which the novel heat treatment was effected on samples of two superalloys NIMONIC 80A (Reg. T.M.) and UDIMET 500 (Reg. T.M.). These are both alloys of nickel with composition ranges as indicated in Table 1, the remainder being nickel.

The creep tests were conducted by taking specimens of standard type design having a central gauge length of 2 × 0.256 dia. and with threaded ends, and subjecting them to sustained tensile stress while contained in furnaces at temperatures of 750°C and 900°C for the NIMONIC 80A and UDIMET 500 alloys respectively. For NIMONIC 80A, the tensile creep stress applied was 15.5 tons/in$^2$. For UDIMENT 500, two tensile creep stresses were applied, 4.79 and 4.07 tons/in$^2$ respectively. During such testing, changes in length were measured continuously as a function of time, using standard electronic or optical extensometers attached to the gauge length of the test specimens. With the electronic extensometer, length changes were recorded automatically on a chart. With the optical extensometer, readings of change in length were taken every few hours, or more or less frequently as required. The sensitivity of these instruments was about $3 \times 10^{-5}$ inches.

TABLE 1

| ALLOY | CHEMICAL COMPOSITIONS OF TWO SUPERALLOYS NOMINAL COMPOSITION, WT.% | | | | | | | | | |
|---|---|---|---|---|---|---|---|---|---|---|
| | C | MN | Si | Cr | Co | Mo | Ti | Al | B | Zr |
| NIMONIC 80A | .06 | .10 | .70 | 19.5 | 1.1 | — | 2.5 | 1.3 | — | — |
| UDIMET 500 | .08 | — | — | 18.0 | 18.5 | 4.0 | 2.9 | 2.9 | .006 | .05 |

Prior to creep testing, rolled bars from both alloys had been heat treated as detailed in Table 2. Each alloy was first solution heat treated and then precipitation hardened.

TABLE 2

| ALLOY | DETAILS OF HEAT TREATMENT SOLUTION TREATMENT | PRECIPITATION HARDENING |
|---|---|---|
| NIMONIC 80A | (a) 8 hrs. at 1080°C, air cool<br>(b) Reheat to 1080°C, water quench | (c) 16 Hrs. at 700°C, air cool |
| UDIMET 500 | (a) 4 Hrs. at 1080°C, air cool | (b) 24 Hrs. at 850°C, air cool<br>(c) 16 Hrs. at 760°C, air cool |

The recuperative heat treatment of the NIMONIC 80A alloy was for a period of 16 hours at 750°C. From Table 2, it will be seen that this is 330C° below the original solution heat treatment temperature (1080°C) of the alloy, and about 50°C above its precipitation hardening heat treatment temperature (700°C). This recuperative heat treatment temperature of 750°C was selected because it is the maximum service temperature of this alloy part, which temperature is considered to be the optimum one for the recuperative heat treatment.

The recuperative heat treatment of the UDIMET 500 alloy was for a period of 26 hours at 900°C. From Table 2, it will be seen that this temperature is 180C° below the original solution heat treatment temperature (1080°C) of the alloy, and 50C° above its higher precipitation hardening heat treatment temperature (850°C). This superalloy part was designed to have a maximum service temperature of 900°C, which is also the temperature chosen for the recuperative heat treatment.

Figure 2:
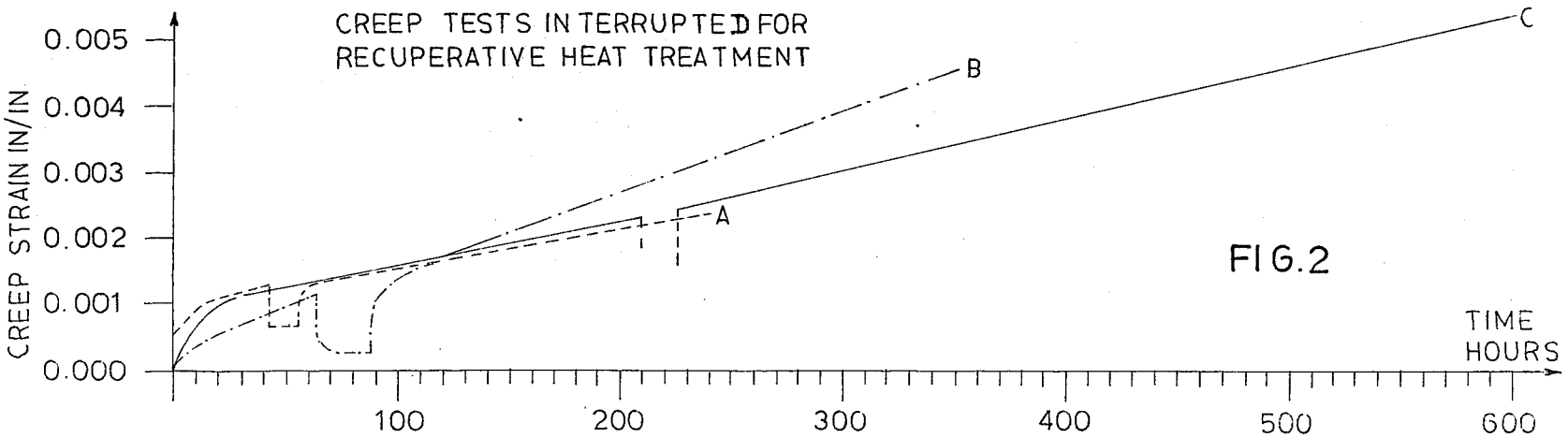
FIG. 2 is a similar chart with respect to the same superalloys as in FIG. 1, but wherein the creep tests were interrupted for the application of a recuperative heat treatment in accordance with the present invention.
Figure 3:
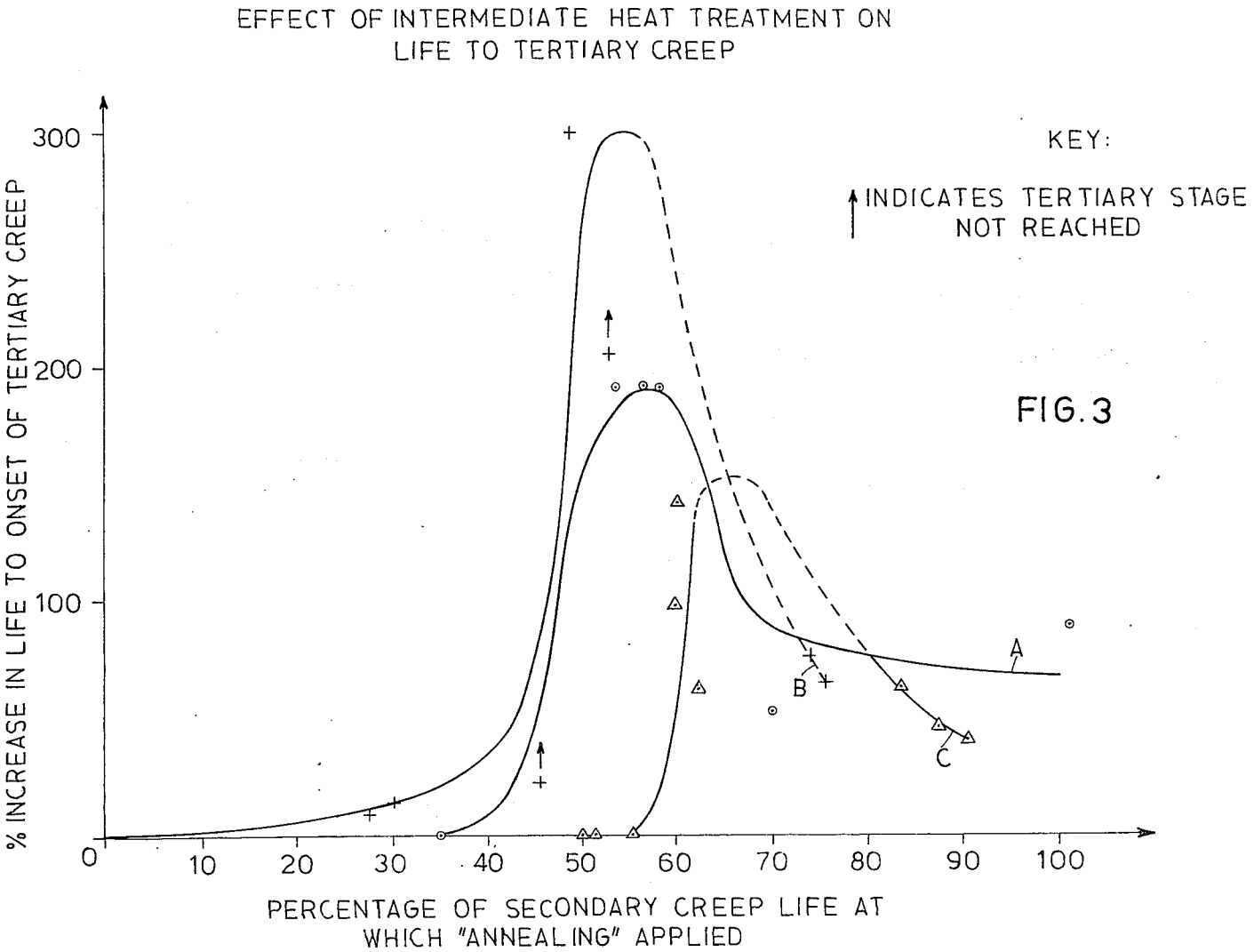
FIG. 3 is a chart illustrating how the increase in the secondary creep life (i.e., before the onset of tertiary creep) varies with the stage of creep (expressed as a percentage of secondary creep experienced) at which the recuperative heat treatment is applied to the same superalloys as in FIGS. 1 and 2.

The diagrams of FIGS. 1–3 clearly illustrate how the secondary creep life of the treated alloy was very substantially extended by the above-described recuperative heat treatments.

Thus, FIG. 1 illustrates the typical creep-extension-vs-time curves for the two above-mentioned alloys when not subjected to the recuperative heat treatment of the present invention. Curve A is that of NIMONIC 80A when subjected to a stress of 15.5 tons/in$^2$ at 750°C; Curve B is that of UDIMET 500 when subjected to a stress of 4.79 tons/in$^2$ at 900°C; and Curve C is that UDIMET 500 when subjected to a stress of 4.07 tons/in$^2$ at 900°C. These temperatures represent the maximum service temperatures of the respective parts. The arrow on each curve is the critical point and indicates the onset of tertiary creep, which is defined as the point of deviation from linearity in the more advanced stage of secondary creep; the straight-line portion of the curve to the left of the arrow represents the complete secondary creep life. Thus, with respect to Curve B, for example, tertiary creep started at about 120 hours, and the secondary creep stage extended for the straight line portion of the curve, from about 30 to 120 hours.

FIG. 2 illustrates the results of the same tests applied to the same superalloys as in FIG. 1, except that: (1) stress was interrupted after each test piece experienced significant secondary creep; (2) the recuperative heat treatment was applied to the respective test piece; and then (3) the test was continued.

Thus as shown with respect to Curve B for example, the stress was removed after 62 hours, the above-described recuperative heat treatment was applied to the unstressed test piece for a period of 26 hours, and the stress was then resumed.

A comparison of the curves of FIG. 2 with the corresponding curves in FIG. 1 shows that very substantial extensions in the secondary creep life of the alloys were obtained by the described recuperative heat treatment. Thus, as shown by Curve A in both figures, the NIMONIC 80A alloy part stressed at 15.5 tons/in$^2$ started to experience tertiary creep at 80 hours of test when it was not subjected to the recuperative heat treatment (FIG. 1) but after it was subjected to the recuperative heat treatment (at about 42 hours, FIG. 2) the secondary creep stage was so extended that after 240 hours of test, tertiary creep had not yet started. Similarly, the UDIMET 500 alloy part, when stressed at 4.79 tons/in$^2$ (Curve B) experienced the onset of tertiary creep at about 120 hours without the recuperative heat treatment (FIG. 1), but when it was subjected to the recuperative heat treatment (FIG. 2), it completed 350 hours without tertiary creep yet starting. Similarly, as the UDIMET 500 part when stressed at 4.07 tons/in$^2$ (Curve C) started to experience tertiary creep at about 370 hours without the recuperative heat treatment (FIG. 1), but when the recuperative heat treatment was applied, it completed 500 hours without showing tertiary creep.

As pointed out above, the recuperative heat treatment should be applied after the alloy part has experienced significant secondary creep but before tertiary creep has set in. It has been found that very substantially different results are obtained depending upon the point in the secondary creep life of the part at which the recuperative heat treatment is applied. This is shown in FIG. 3, which illustrates the same three specimens described above with reference to FIGS. 1 and 2, and identified by the corresponding letters A, B, C, the curves in FIG. 3 showing how the increase in the life of the part, before the onset of tertiary creep, varies with the percentage of secondary creep life at which the recuperative heat treatment is applied.

Thus, as shown by Curve A, a very high increase in secondary creep life is produced with respect to NIMONIC 80A stressed at 15.5 tons/in$^2$ when the recuperative heat treatment is applied between about 45–65% of the secondary creep life, the peak being at about 55%. Curve B shows that substantially the same results were obtained with respect to UDIMET 500 stressed at 4.79 tons/in$^2$. Curve C, however, shows that the peak in the increase of secondary creep life is obtained with respect to UDIMET 500 stressed at 4.07 tons/in$^2$ when the recuperative heat treatment is applied between about 60–70% of the secondary creep life.

While the recuperative heat treatment described above is particularly useful for increasing the secondary creep life of nickel-base superalloys as shown by the foregoing examples, it may also be advantageously used with respect to other alloys, such as those of cobalt, high temperature stainless steels, low alloy steels, titanium, aluminium and magnesium. Creep damage due to vacancy clustering is believed to be common to many of the foregoing metals, and therefore the same general mechanism of action by which the above-described recuperative heat treatment extends the secondary creep life of the superalloy, should also be applicable to the other alloys. However, the optimum time for applying the heat treatment, as well as the duration and temperature of the heat treatment, may vary according to the alloy, and its particular operating conditions of stress and temperature.

Following are additional examples of some of these other alloys and the recuperative heat treatment that may be applied to them to extend their secondary creep life.

The recuperative heat treatment should be effective on all parts subjected to sustained or intermittent tensile stress applied at elevated temperatures, under conditions which would normally lead to creep of the material. The process should therefore find application particularly to turbine parts such as blades and discs.

It is furthermore believed that where conditions of mechanical fatigue obtaining at elevated temperatures, and thermal fatigue due to cycling between different temperatures, result in intergranular cracking also because of clustering of vacancies at these sites, then the

| TYPE | NAME | ALLOY Nominal Compositions Wt.% | | | | | | | | | | | |
|---|---|---|---|---|---|---|---|---|---|---|---|---|---|
| | | C | Si | Mn | Cr | Ni | Co | Mo | W | Cb | Ti | Al | B |
| Cobalt-Base Super-Alloys | W152 | 0.45 | 0.50 | 0.50 | 21 | 1.0 | Bal. | — | 11 | 20 | — | — | — |
| | MAR-M302 | 0.85 | 0.20 | 0.10 | 21.5 | — | Bal. | — | 10 | — | — | — | 0.005 |
| Iron-Nickel Base Alloys (High Temperature Stainless Steels) | A286 | 0.05 | 0.04 | 1.40 | 15 | 26 | — | 1.25 | — | — | 2.15 | 0.2 | 0.003 |
| | Discaloy | 0.04 | 0.80 | 0.90 | 13.5 | 26 | — | 2.75 | — | — | 1.75 | 0.10 | — |
| Titanium Alloys | Ti-6-4 | — | — | — | — | — | — | — | — | — | Bal. | 6.0 | — |
| | Ti-5-2½ | — | — | — | — | — | — | — | — | — | Bal. | 5.0 | — |
| Aluminium Alloys | 2024-T81 | — | 0.5 | 0.6 | 0.1 | — | — | — | — | — | — | Bal | — |
| | 2014-T6 | — | 0.8 | 0.8 | 0.1 | — | — | — | — | — | — | 0.15 | Bal. |

| TYPE | NAME | ALLOY Nominal Compositions Wt.% | | | | | | | RECUPERATIVE HEAT TREATMENT |
|---|---|---|---|---|---|---|---|---|---|
| | | Zr | Fe | V | Sn | Cu | Mg | Zn | |
| Cobalt-Base Super-Alloys | W152 | — | 2.0 | — | — | — | — | — | 16 hrs. at 950°C |
| | MAR-M302 | 0.15 | — | — | — | — | — | — | 16 hrs. at 950°C |
| Iron-Nickel Base Alloys (High Temperature Stainless Steels) | A286 | — | Bal. | 0.03 | — | — | — | — | 16 hrs. at 700°C |
| | Discalo | — | Bal. | — | — | — | — | — | 16 hrs. at 700°C |
| Titanium Alloys | Ti-6-4 | — | 0.3 | 4.0 | — | — | — | — | 16 hrs. at 550°C |
| | Ti-5-2½ | — | — | — | 2.5 | — | — | — | 16 hrs. at 550°C |
| Aluminium Alloys | 2024-T81 | — | 0.5 | — | — | 4.5 | 1.5 | 0.25 | 16 hrs. at 175°C |
| | 2014-T6 | — | 0.7 | — | — | 4.4 | 0.5 | 0.25 | 16 hrs. at 145°C |

above-described recuperative heat treatment should also be found to be effective in ameliorating such damage. 4

Further variations, modifications and applications of the illustrated embodiments will be apparent.

What is claimed is:

1. A method of extending the secondary creep life of a part of an alloy which alloy had previously been subjected to a solution heat treatment at a high temperature and to a subsequent precipitation hardening heat treatment at a lower temperature, characterized in subjecting the part, after it has experienced significant secondary creep because of sustained stress at an elevated service temperature but before tertiary creep has set in, to a recuperative heat treatment at a temperature substantially below the solution heat treatment temperature while the part is unstressed.

2. The method according to Claim 1, wherein the alloy is a nickel, cobalt, iron, titanium or aluminium base alloy.

3. The method of Claim 1, wherein the recuperative heat treatment is applied at a temperature above the precipitation hardening heat treatment temperature.

4. The method of Claim 1, wherein the recuperative heat treatment is applied for at least one hour at a temperature no higher than the maximum service temperature of the part.

5. The method of Claim 1, wherein the recuperative heat treatment is applied for at least one hour at a temperature substantially equal to the maximum service temperature of the part.

6. The method of Claim 1, wherein the alloy is a nickel-base superalloy.

7. The method according to Claim 6, wherein the recuperative heat treatment is applied at a temperature which is at least 150C° below the solution heat treatment temperature.

8. The method according to Claim 6 wherein the recuperative heat treatment is applied at a temperature between the precipitation hardening heat treatment temperature and the maximum service temperature of the part.

9. The method according to Claim 6 wherein the nickel-base superalloy is subjected to the recuperative heat treatment after the part has experienced from about 45–70% secondary creep.

10. The method according to Claim 9, wherein the superalloy is NIMONIC 80A, and is subjected to the recuperative heat treatment after it has experienced about 50–60% secondary creep.

11. The method according to Claim 9, wherein the superalloy is UDIMET 500, and is subjected to the recuperative heat treatment after it has experienced about 60–70% secondary creep.

* * * * *